US005303556A

United States Patent [19]

Dray et al.

[11] Patent Number: 5,303,556

[45] Date of Patent: Apr. 19, 1994

[54] SINGLE COLUMN CRYOGENIC RECTIFICATION SYSTEM FOR PRODUCING NITROGEN GAS AT ELEVATED PRESSURE AND HIGH PURITY

[75] Inventors: James R. Dray, Kenmore; Mark J. Roberts; Dante P. Bonaquist, both of Grand Island; Harry Cheung, Williamsville; Paul L. Just, Tonawanda; James B. Mize, Williamsville; John H. Royal, Grand Island, all of N.Y.

[73] Assignee: Praxair Technology, Inc., Danbury, Conn.

[21] Appl. No.: 6,408

[22] Filed: Jan. 21, 1993

[51] Int. Cl.[5] ..... F25J 3/02

[52] U.S. Cl. ..... 62/24; 62/39; 62/41

[58] Field of Search ..... 62/24, 39, 41

[56] References Cited

U.S. PATENT DOCUMENTS

| | | | |
|---|---|---|---|
| 4,006,001 | 2/1977 | Schonpflug | 62/41 |
| 4,372,764 | 2/1983 | Theobald | 62/41 |
| 4,400,188 | 8/1983 | Patel et al. | 62/13 |
| 4,594,085 | 6/1986 | Cheung | 62/25 |
| 4,595,405 | 6/1986 | Agrawal et al. | 62/18 |
| 4,604,117 | 8/1986 | Cheung | 62/25 |
| 4,617,036 | 10/1986 | Suchdeo et al. | 62/11 |
| 4,662,916 | 5/1987 | Agrawal et al. | 62/13 |
| 4,662,917 | 5/1987 | Cormier, Sr. et al. | 62/13 |
| 4,662,918 | 5/1987 | Agrawal et al. | 62/13 |
| 4,717,410 | 1/1988 | Grenier | 62/41 |
| 4,796,431 | 1/1989 | Erickson | 62/31 |
| 4,834,785 | 5/1989 | Ayres | 62/38 |
| 4,848,996 | 7/1989 | Thorogood et al. | 62/39 |
| 4,867,773 | 9/1989 | Thorogood et al. | 62/39 |
| 4,872,893 | 10/1989 | Agrawal et al. | 62/11 |
| 5,098,457 | 3/1992 | Cheung et al. | 62/24 |
| 5,123,946 | 6/1992 | Ha | 62/11 |
| 5,144,808 | 9/1992 | Ha | 62/24 |
| 5,148,680 | 9/1992 | Dray | 62/24 |

FOREIGN PATENT DOCUMENTS

| | | |
|---|---|---|
| 343065 | 11/1989 | European Pat. Off. . |
| 413631 | 2/1991 | European Pat. Off. . |

OTHER PUBLICATIONS

Producing Nitrogen at the Point of Use, T. Hardenburger, Chemical Engineering, Oct., 1992, pp. 136–146.

*Primary Examiner*—Ronald C. Capossela
*Attorney, Agent, or Firm*—Stanley Ktorides

[57] ABSTRACT

A single column lower pressure cryogenic rectification system wherein nitrogen top vapor is condensed against column bottoms, elevated in pressure, and vaporized against elevated pressure fluid to achieve simultaneously high purity and high pressure nitrogen gas product.

8 Claims, 4 Drawing Sheets

SINGLE COLUMN CRYOGENIC RECTIFICATION SYSTEM FOR PRODUCING NITROGEN GAS AT ELEVATED PRESSURE AND HIGH PURITY

TECHNICAL FIELD

This invention relates generally to the cryogenic rectification of mixtures comprising oxygen and nitrogen, e.g. air, and more particularly to the production of elevated pressure nitrogen gas product with improved purity.

BACKGROUND ART

The cryogenic separation of mixtures such as air to produce nitrogen is a well established industrial process. Liquid and vapor are passed in countercurrent contact through a column of a cryogenic rectification plant and the difference in vapor pressure between the oxygen and nitrogen causes nitrogen to concentrate in the vapor and oxygen to concentrate in the liquid. The lower the pressure is in the separation column, the easier is the separation due to vapor pressure differential. Accordingly, the separation for producing product nitrogen is generally carried out at a relatively low pressure.

Often product nitrogen gas is desired at a high pressure. In such situations, the product nitrogen gas is compressed to the desired pressure in a compressor. This compression is costly in terms of energy costs as well as capital costs for the product compressors. Moreover, the compression of the nitrogen product gas may generate impurities such as particulates and these impurities may be detrimental if the nitrogen gas is to be used in an application requiring high purity, such as in the manufacture of semiconductors. In such instances, a further purification step for the nitrogen gas product may be necessary.

Another way of producing high pressure nitrogen product gas is to operate the column of the cryogenic air separation plant at an elevated pressure. In many cases, this is disadvantageous because the column operating pressure required to produce the desired product pressure is higher than that pressure which gives the optimal cycle efficiency, resulting in increased operating costs.

Accordingly, it is an object of this invention to provide a cryogenic rectification system wherein product nitrogen gas may be efficiently produced while avoiding high operating pressures within the cryogenic rectification plant and avoiding the need to compress nitrogen gas product.

SUMMARY OF THE INVENTION

The above and other objects which will become apparent to one skilled in the art upon a reading of this disclosure are attained by the present invention one aspect of which is:

A cryogenic rectification method for producing elevated pressure nitrogen gas comprising:

(A) compressing a feed comprising nitrogen and oxygen;

(B) cooling compressed feed and passing resulting cooled feed into a column;

(C) separating feed within the column by cryogenic rectification into nitrogen-rich vapor and oxygen-enriched liquid;

(D) vaporizing oxygen-enriched liquid by indirect heat exchange with nitrogen-rich vapor to produce nitrogen-rich liquid and oxygen-enriched vapor;

(E) increasing the pressure of nitrogen-rich liquid to produce elevated pressure nitrogen-rich liquid;

(F) vaporizing elevated pressure nitrogen-rich liquid by indirect heat exchange with compressed fluid to produce elevated pressure nitrogen gas; and (G) recovering elevated pressure nitrogen gas as product.

Another aspect of this invention is:

Apparatus for producing elevated pressure nitrogen gas by cryogenic rectification comprising:

(A) a column and means for providing a feed comprising nitrogen and oxygen into the column;

(B) means for passing fluid taken from the lower portion of the column in indirect heat exchange with fluid taken from the upper portion of the column;

(C) means for increasing the pressure of fluid taken from the upper portion of the column;

(D) a product vaporizer and means for passing said increased pressure fluid to the product vaporizer for vaporization;

(E) a compressor and means for passing fluid from the compressor to the product vaporizer to vaporize said increased pressure fluid; and (F) means for recovering as product increased pressure vaporized fluid from the product vaporizer.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", *B. D. Smith, et al.*, page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile components(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 133 degrees K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "equilibrium stage" means a contact process between vapor and liquid such that the exiting vapor and liquid streams are in equilibrium.

As used herein, the terms "upper portion" and "lower portion" of a column mean respectively the upper half and the lower half of the column.

DETAILED DESCRIPTION

The invention will be described in detail with reference to the Drawings.

Figure 1:
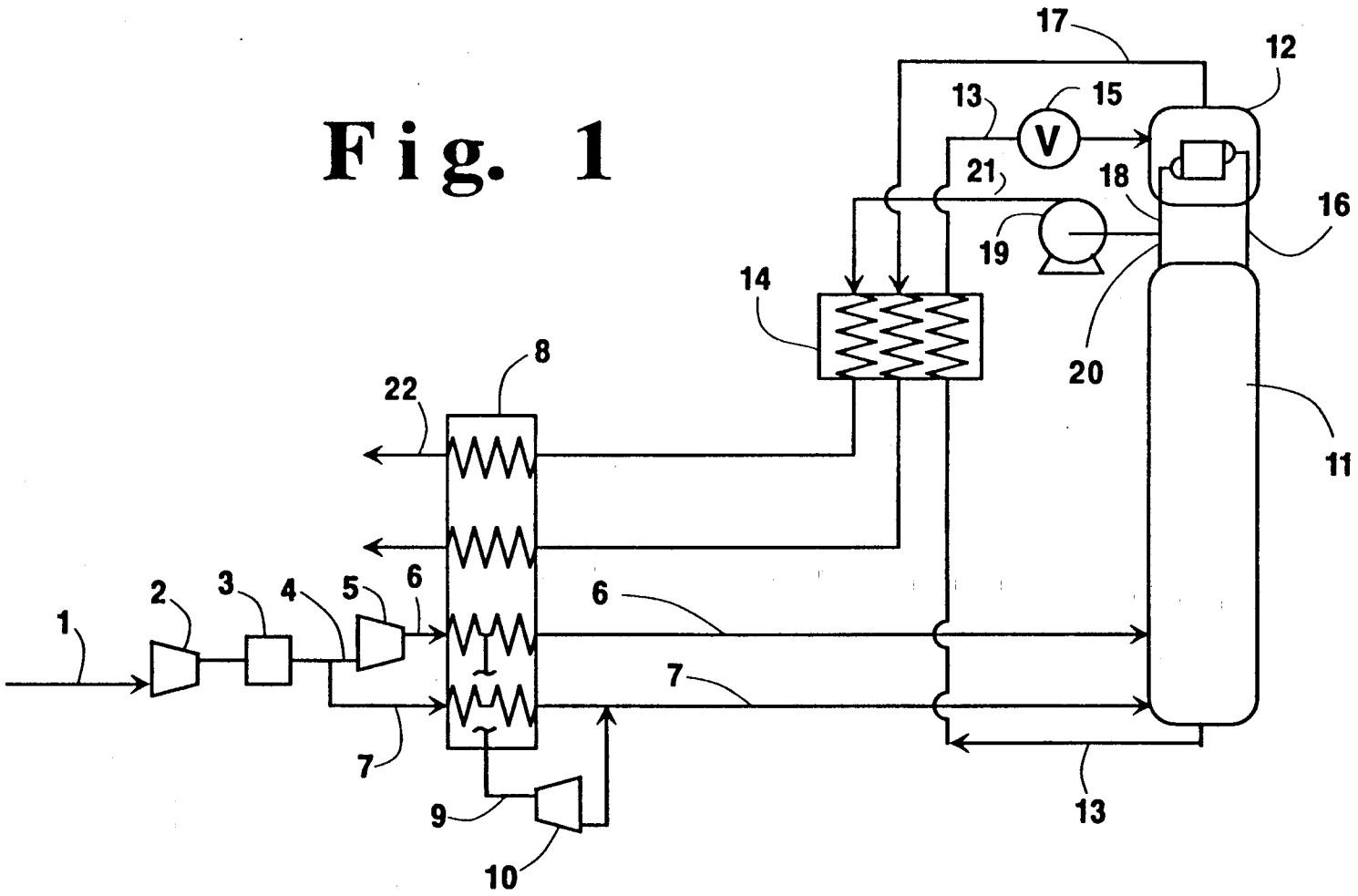
FIG. 1 is a schematic representation of one embodiment of the invention wherein nitrogen-rich liquid is vaporized by heat exchange with feed.

Referring now to FIG. 1, feed air 1 is compressed by passage through main compressor 2 and then cleaned of high boiling impurities such as carbon dioxide and water vapor by passage through molecular sieve prepurifier 3. Reversing heat exchangers may also be employed to clean the feed of high boiling impurities. A fraction 4 of the compressed feed air is further compressed by passage through booster compressor 5. Resulting further compressed fraction 6 as well as remaining feed air fraction 7 are cooled by passage through main heat exchanger 8. A portion 9 of further compressed fraction 6 is removed from heat exchanger 8 at an intermediate point, work expanded by passage through turboexpander 10 to generate refrigeration and passed into stream 7. Further compressed fraction 6 is at least partially condensed by passage through heat exchanger 8. Resulting cooled streams 6 and 7 are passed in cryogenic rectification column 11. Preferably stream 6 is passed into column 11 at a point at least one equilibrium stage above the point where stream 7 is passed into column 11.

Column 11 is operating at a pressure less than 125 pounds per square inch absolute (psia), preferably less than 70 psia and most preferably at a pressure less than 60 psia. Generally, the operating pressure of column 11 will be within the range of from 35 to 50 psia. The relatively low operating pressure of column 11 facilitates the separation of the feed. Within column 11, the feed is separated by cryogenic rectification into nitrogen-rich vapor and oxygen-enriched liquid. Column 11 comprises at least one top condenser such as top condenser 12. Oxygen-enriched liquid, generally having an oxygen concentration within the range of from 30 to 55 mole percent, is passed in stream 13 through heat exchanger 14 wherein it is subcooled, passed through valve 15 and then passed into top condenser 12 of column 11. Nitrogen-rich vapor 16 is also passed into top condenser 12 wherein oxygen-enriched liquid is vaporized by indirect heat exchange with nitrogen-rich vapor taken from the column to produce nitrogen-rich liquid and oxygen-enriched vapor. Resulting oxygen-enriched vapor 17 is warmed by passage through heat exchangers 14 and 8 and removed from the system.

Nitrogen-rich liquid 18 is increased in pressure preferably by passage through a liquid pump such as liquid pump 19. A portion 20 of nitrogen-rich liquid is used as reflux for column 11. The pressure of nitrogen-rich liquid is elevated to be within the range of from 45 to 250 psia. Any other effective means of raising the pressure of nitrogen-rich liquid may also be used in the practice of this invention. Pressurized nitrogen-rich liquid 21 is warmed by passage through heat exchanger 14 and is vaporized by passage through heat exchanger 8 by indirect heat exchange with the cooling compressed feed. Preferably the compressed fluid at least partially condenses by the indirect heat exchange with the pressurized nitrogen-rich liquid. The resulting elevated pressure nitrogen gas 22 is recovered as product containing from 10 ppm (molar) to 0.1 ppb (molar) oxygen and at a pressure within the range of from 45 to 250 psia without need for product gas compression. In the practice of this invention, at least 50 percent and preferably at least 90 percent of the nitrogen-rich vapor recovered from the process is taken from the column, pumped to elevated pressure and vaporized.

Figure 2:
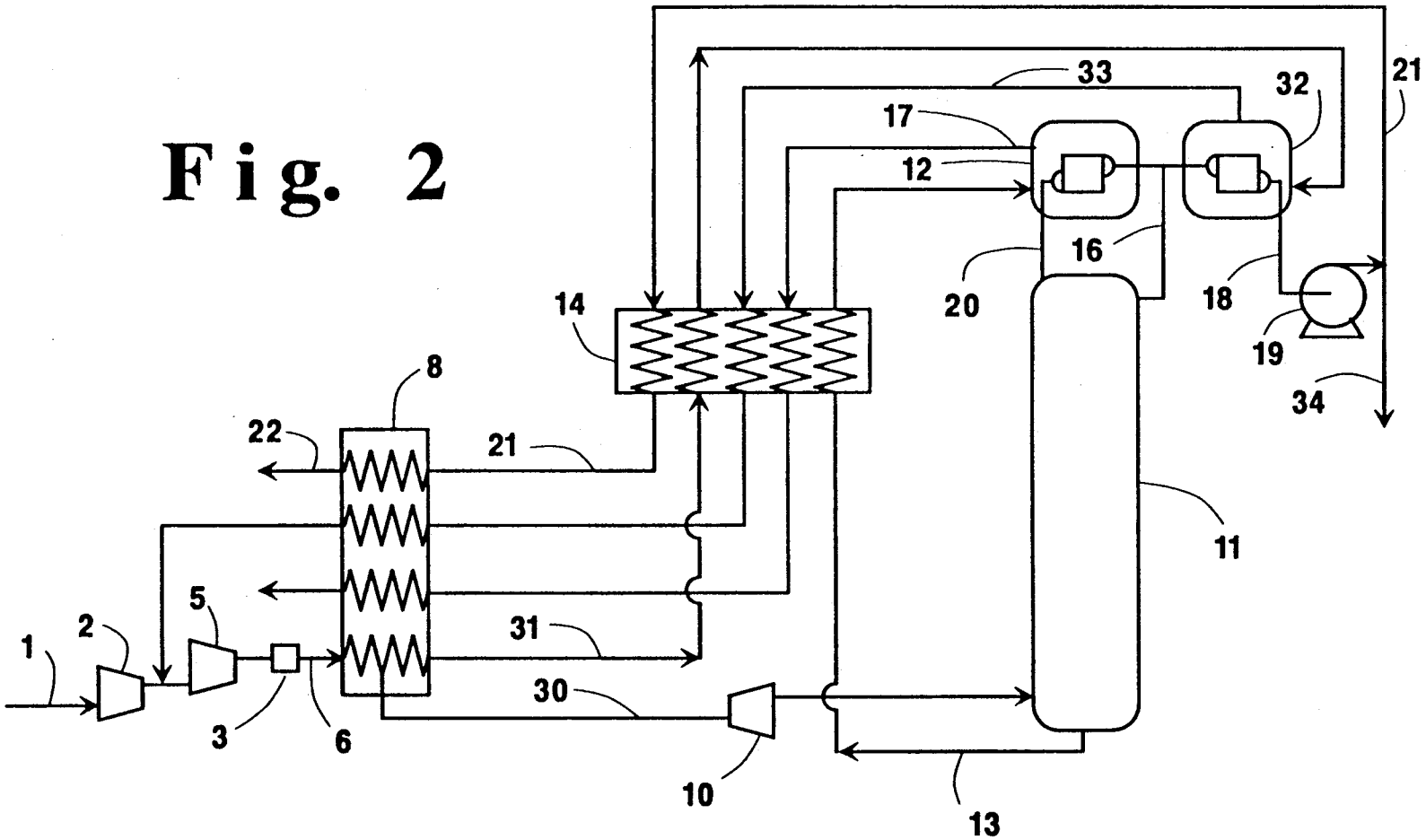
FIG. 2 is a schematic representation of another embodiment of the invention wherein additional nitrogen-rich liquid is generated by heat exchange with feed.

FIG. 2 illustrates another embodiment of the invention which employs two top condensers as part of the rectification column. The numerals in FIG. 2 correspond to those of FIG. 1 for the corresponding elements and these corresponding elements will not be described again in detail. Referring now to FIG. 2, all of the feed air is further compressed and a portion 30 is withdrawn from an intermediate point of heat exchanger 8, turboexpanded through expander 10 and passed into column 11. Another portion 31 of the feed air is passed into auxiliary top condenser 32 wherein there is also passed nitrogen-rich vapor 16. Feed air is passed out from auxiliary top condenser 32 as stream 33, warmed by passage through heat exchangers 14 and 8 is recombined with feed stream 1 between compressors 1 and 5. A portion 34 of the nitrogen-rich liquid may be recovered as product liquid nitrogen in addition to the product nitrogen gas. The embodiment illustrated in FIG. 2 is advantageous in that a higher recovery of nitrogen is possible over that attainable with the embodiment illustrated in FIG. 1. This is due to a reduction in the amount of liquid feed passed into the column over what would be the case with the embodiment illustrated in FIG. 1.

Figure 3:
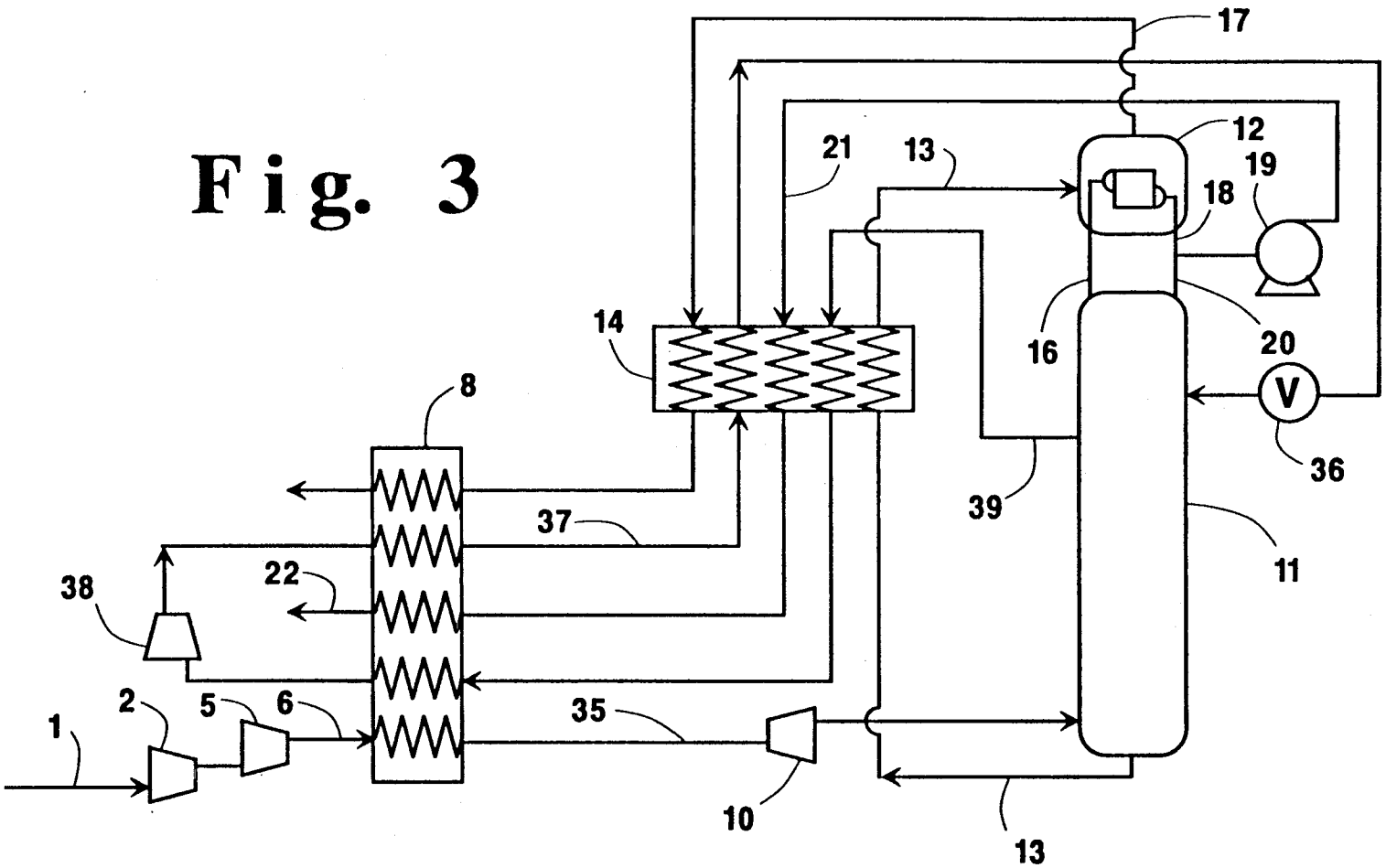
FIG. 3 is a schematic representation of another embodiment of the invention wherein nitrogen-rich liquid is vaporized by heat exchange with nitrogen vapor taken from the column.

FIG. 3 illustrates another embodiment of the invention wherein nitrogen fluid is used to vaporize the nitrogen-rich liquid. The numerals in FIG. 3 correspond to those of FIG. 1 for the corresponding elements and these corresponding elements will not be described again in detail. Referring now to FIG. 3, all of the further compressed feed air passes through heat exchanger 8 and turboexpander 10 as stream 35 and is passed into column 10. A vapor stream 39 comprising from 98 to 99.999 percent nitrogen is withdrawn from column 11, warmed by passage through heat exchangers 14 and 8, compressed by passage through compressor 38 and passed back through heat exchanger 8 wherein it serves to vaporize nitrogen-rich liquid 21. Resulting nitrogen fluid 37, which preferably has been at least partly condensed by the passage through heat exchanger 8, is passed back through heat exchanger 14, through valve 36 and back into column 11, preferably at a point at least one equilibrium stage above the point where stream 39 was withdrawn from column 11. In the embodiment illustrated in FIG. 3, the heat exchange between the compressed nitrogen stream and the nitrogen-rich liquid is shown as occurring in single heat exchanger 8. However, this is not required and such heat exchange could occur in a separate heat exchanger. That is, main heat exchanger 8 could alternatively be two or more separate heat exchangers.

Figure 4:
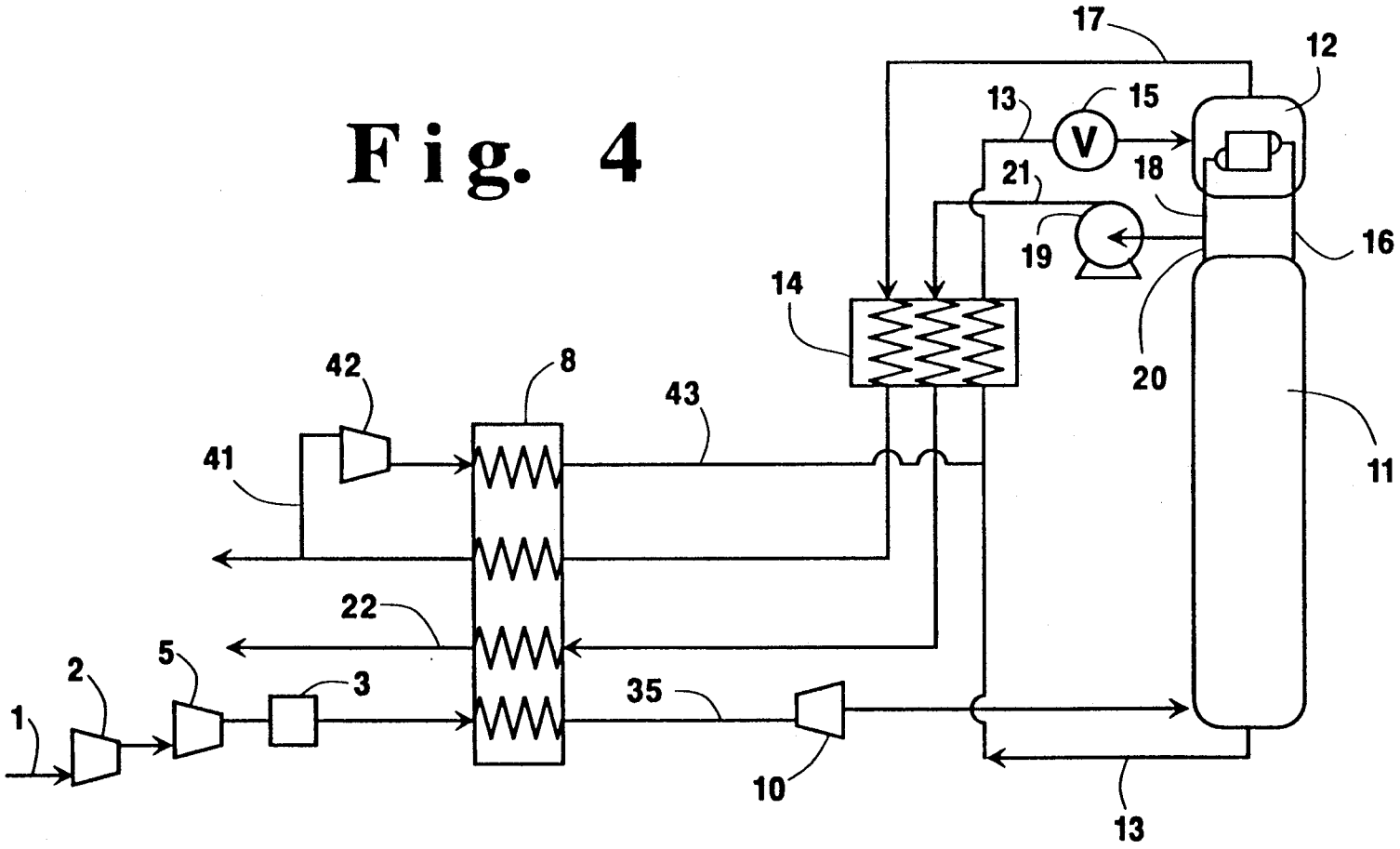
FIG. 4 is a schematic representation of another embodiment of the invention wherein nitrogen-rich liquid is vaporized by heat exchange with oxygen-enriched vapor.

FIG. 4 illustrates another embodiment of the invention wherein oxygen-enriched fluid is used to vaporize the nitrogen-rich liquid. The numerals in FIG. 4 correspond to those of the preceding Figures for the corresponding elements and these corresponding elements will not be described again in detail. Referring now to FIG. 4, a portion 41 of oxygen-enriched fluid 17 is compressed by passage through compressor 42 and passed back through heat exchanger 8 wherein it serves to vaporize nitrogen-rich liquid 21. Resulting oxygen-enriched fluid 43, which preferably has been at least partially condensed, is passed into stream 13 and then through heat exchanger 14 and valve 15 into top condenser 12. In the embodiment illustrated in FIG. 4, the heat exchange between the compressed oxygen-enriched vapor and the nitrogen-rich liquid is shown as occurring in single heat exchanger 8. However, this is not necessary and such heat exchange could occur in a separate heat exchanger. That is, main heat exchanger 8 could alternatively be two separate heat exchangers.

Now, by the use of this invention, one can produce nitrogen gas with a single column cryogenic rectification plant at an elevated pressure while avoiding the need to compress product nitrogen gas. Although the invention has been described in detail with reference to certain preferred embodiments, those skilled in the art will recognize that there are other embodiments of the invention within the spirit and the scope of the claims. For example, in each of the embodiments illustrated in the Figures, the main heat exchanger also serves as the product vaporizer. However, as also discussed in the specification, the nitrogen-rich liquid may be vaporized in a separate heat exchanger from the main heat exchanger wherein the feed is cooled, and in such a case, this separate heat exchanger would be the product vaporizer of the invention.

We claim:

1. A cryogenic rectification method for producing elevated pressure nitrogen gas comprising:

(A) compressing a feed comprising nitrogen and oxygen;

(B) cooling compressed feed and passing resulting cooled feed into a column;

(C) separating feed within the column by cryogenic rectification into nitrogen-rich vapor and oxygen-enriched liquid;

(D) vaporizing oxygen-enriched liquid by indirect heat exchange with nitrogen-rich vapor to produce nitrogen-rich liquid and oxygen-enriched vapor;

(E) increasing the pressure of nitrogen-rich liquid to produce elevated pressure nitrogen-rich liquid;

(F) vaporizing elevated pressure nitrogen-rich liquid by indirect heat exchange with compressed fluid to produce elevated pressure nitrogen gas; and (G) recovering elevated pressure nitrogen gas as product.

2. The method of claim 1 wherein the compressed fluid is feed.

3. The method of claim 1 wherein the compressed fluid is oxygen-enriched vapor.

4. The method of claim 1 wherein the compressed fluid is nitrogen-containing fluid taken from the column and returned to the column after the heat exchange with the pressurized nitrogen-rich liquid.

5. The method of claim 1 wherein the compressed fluid is at least partially condensed by the heat exchange with the pressurized nitrogen-rich liquid.

6. The method of claim 1 wherein at least some cooled, compressed feed is turboexpanded prior to being passed into the column.

7. The method of claim 1 further comprising producing some nitrogen-rich liquid by indirect heat exchange of nitrogen-rich vapor with a portion of the feed.

8. Apparatus for producing elevated pressure nitrogen gas by cryogenic rectification comprising:

(A) a column and means for providing a feed comprising nitrogen and oxygen into the column;

(B) means for passing fluid taken from the lower portion of the column in indirect heat exchange with fluid taken from the upper portion of the column;

(C) means for increasing the pressure of fluid taken from the upper portion of the column;

(D) a product vaporizer and means for passing said increased pressure fluid to the product vaporizer for vaporization;

(E) a compressor and means for passing fluid from the compressor to the product vaporizer to vaporize said increased pressure fluid; and (F) means for recovering as product increased pressure vaporized fluid from the product vaporizer.

* * * * *